US007066070B2

(12) United States Patent
Granger et al.

(10) Patent No.: US 7,066,070 B2
(45) Date of Patent: Jun. 27, 2006

(54) DEVICE FOR CONTROLLING AND REPOSITIONING A ROLL OF WIPING MATERIAL IN AN AUTOMATIC CUTTING DISPENSER

(76) Inventors: Maurice Granger, 17 Rue Marcel Pagnol, Saint Priest en Jarez (FR) F-42270; Daniel Granger, La Tranchais, Saint Germain de Princay (FR) F-85110; Sabine Granger, 4 Square Violette, Saint Etienne (FR) F-42000; Smeralda Granger, 8 Rue Praire, Saint Etienne (FR) F-42000

( * ) Notice: Subject to any disclaimer, the term of this patent is extended or adjusted under 35 U.S.C. 154(b) by 0 days.

(21) Appl. No.: 10/881,838

(22) Filed: Jun. 30, 2004

(65) Prior Publication Data

US 2004/0245265 A1 Dec. 9, 2004

Related U.S. Application Data

(63) Continuation of application No. PCT/FR02/04446, filed on Dec. 19, 2002.

(30) Foreign Application Priority Data

Jan. 9, 2002 (FR) ..... 02 00343

(51) Int. Cl.
*A47K 10/36* (2006.01)

(52) U.S. Cl. ..... 83/649; 83/337; 242/564; 242/564.4; 225/13

(58) Field of Classification Search ..... 225/16, 225/11, 13–15, 23, 24, 90; 83/633, 649, 83/337, 332, 339; 242/564, 564.2, 564.4, 242/564.5

See application file for complete search history.

(56) References Cited

U.S. PATENT DOCUMENTS

| | | | | |
|---|---|---|---|---|
| 4,122,738 | A | 10/1978 | Granger | 83/314 |
| 4,188,844 | A * | 2/1980 | DeLuca | 83/337 |
| 4,189,077 | A * | 2/1980 | Hartbauer et al. | 225/14 |
| 4,621,755 | A | 11/1986 | Granger | 225/96 |
| 4,635,837 | A | 1/1987 | Granger | 225/96 |
| 5,146,830 | A | 9/1992 | Granger | 83/649 |
| 5,868,343 | A * | 2/1999 | Granger | 242/564.4 |
| 6,179,243 | B1 | 1/2001 | Granger | 242/564.5 |
| 6,196,102 | B1 * | 3/2001 | Granger | 83/335 |
| 2001/0045149 | A1 | 11/2001 | Granger | 83/335 |
| 2002/0030075 | A1 | 3/2002 | Granger | 225/16 |

FOREIGN PATENT DOCUMENTS

| | | |
|---|---|---|
| FR | 2332215 | 6/1977 |
| FR | 2340887 | 9/1977 |

(Continued)

*Primary Examiner*—Allan N. Shoap
*Assistant Examiner*—Omar Flores Sánchez
(74) *Attorney, Agent, or Firm*—Heslin Rothenberg Farley & Mesiti P.C.

(57) ABSTRACT

A machine for dispensing a strip of material comprises a housing accommodating an internally hollow drum with a longitudinal slit which accommodates an articulated cutting device, and two end shields of articulated design to accommodate a reel holder which supports a reel of wipe material. The drum is associated with means of starting, and a load button. The machine is distinctive in that it includes a device for monitoring and repositioning the reel of wipe material which comes into action once during each revolution of the drum. The device being designed on the drum and having localized contact with the reel once during each revolution of the drum and causing said reel to be repositioned.

4 Claims, 5 Drawing Sheets

FOREIGN PATENT DOCUMENTS

| | | |
|---|---|---|
| FR | 2555975 | 6/1985 |
| FR | 2656601 | 7/1991 |
| FR | 2764278 | 12/1998 |
| FR | 2 791 655 | 10/2000 |

* cited by examiner

5 b
6
1a
1b
3b
P2
3b
P1
12
9
10
11
3d
3c
4
5b
5a
8
7
5

DEVICE FOR CONTROLLING AND REPOSITIONING A ROLL OF WIPING MATERIAL IN AN AUTOMATIC CUTTING DISPENSER

CROSS REFERENCE TO RELATED APPLICATIONS

This application is a continuation of International Application PCT/FR02/04446 filed on Dec. 19, 2002, and published in French as International Publication WO 03/056993 A1 on Jul. 17, 2003, and claims priority of French patent application number 02.00343 filed on Jan. 9, 2002, the full contents of these applications being incorporated by reference herein.

BACKGROUND OF THE INVENTION

The invention relates to the technical field of dispensing machines for wipe paper made of tissue paper, crepe paper and similar material intended, in particular, for wiping the user's hands, dispensing toilet paper and dispensing paper towels.

The Applicant has developed many patents for machines of the above-mentioned type based on a concept defined in French Patents No. 2,332,215, No. 2,340,887.

The features of such machines are restated briefly below. They essentially comprise a housing (1) having a back (1*a*) and two lateral wings (1*b*), the lower part of said housing extending with a slanting profile (1*c*), this assembly having a suitable profile making it possible to accommodate and articulate a cover (2). The lower part of the housing is capable of accommodating, in a known manner, an internally hollow drum (3) to accommodate a cutting device (4). The upper part of the housing accommodates two end shields (5*a*) (5*b*) capable of accommodating an articulated reel holder (6) having end fittings (6*d*) to support and feed a reel of wipe material (b). The wipe reel rests on drum (3) allowing the strip of material to pass and be unwound at the rear of the machine between the drum and the rear wall of the housing so that said strip of material is capable of emerging from the lower part of the machine. The periphery of the drum has a non-slip friction strip (3*a*) which is in contact with the material making it possible to grip it and facilitate tearing after cutting. To ensure the reel of material is held against the drum, it is necessary to exert a certain amount of constant pressure whilst the reel of material is being unwound regardless of the forces applied.

During development of machines of the above-mentioned type, a safety roller (7) capable of being associated with a guide and transmission belt (8) which links the safety rollers and said drum was incorporated in the lower part of the machine. An arrangement of this type is described in French Patent No. 2,555,975 in particular.

The drum may be of the type described in above-mentioned French Patents but it may alternatively provide, as in French Patent No. 89/17570, two openings (3*b*) made in the periphery of the drum making it possible to orientate and guide corresponding parts of the strip of material if the user pulls the end of the strip of material at an angle, applying a tensile force which is not in conformity with the normal tensile force exerted along a line which is an extension of the front of the machine.

The Applicant has also developed a special device used to monitor correct unwinding of the strip of paper material depending on the diameter and the weight of the roll of paper and depending on the tensile force exerted on the protruding end of the strip of paper which emerges from the machine. Such a device is described in French Patent No. 2,764,278.

During operation of machines of the above-mentioned type which use all or some of the aspects restated briefly above, the Applicant has observed, during use, a problem in retaining the reel of material relative to its support end shields (5*a*–5*b*). Regardless of the characteristics of said end shields and their embodiment, during use slight swivelling of the reel towards the left at an angle (a) of a few degrees is observed and this causes the machine to stop working and prevents the dispensing of paper.

This situation has been encountered regardless of the tensile force exerted by the user and regardless of the configuration of the drum.

The reel support end shields (5*a*–5*b*) then press against the wings (1*b*) of the housing and the strip of paper is pinched and cannot directly escape through the lower opening in the machine.

In order to overcome this drawback, the user must then actuate the manual load button (9) located on the side of the machine which causes rotation of the drum and ejection of the strip of material. The load button must be operated in order to return the machine to normal working order. Although this operation is not really awkward in itself, it is nevertheless a nuisance to the user who is given the impression that the machine operates unpredictably. It also means that the user must remember to actuate the load button and this is far from obvious given the fact that these types of dispensing machines are installed in public areas where there are huge numbers of potential users.

Document U.S. Pat. No. 4,621,755 defines the preamble of claim 1.

BRIEF SUMMARY OF THE INVENTION

The approach adopted by the Applicant was therefore to attempt to improve the operation of such wipe material dispensing machines by eliminating the need for occasional intervention by operating the load button and enabling automatic and even dispensing of strips of material with constant monitoring of the positioning of the reel of material inside the machine.

According to a first aspect, the machine for dispensing a strip of material with automatic cutting of the type comprising a housing (1) having a back (1*a*), two lateral wings (1*b*), the lower part of which extends with a slanting profile (1*c*) and accommodating a cover (2), said housing accommodating an internally hollow drum (3) with a longitudinal slit which accommodates an articulated cutting device (4), said housing accommodating two end shields (5*a*–5*b*) of articulated design to accommodate a reel holder (6) which supports a reel of wipe material (b), said drum having, over part of its periphery, a non-slip strip (3*a*), said drum being associated with means of starting, a cam (10) and return spring (11) and a load button (9), is characterised in that it comprises a device for monitoring and repositioning the reel of wipe material which comes into action during each revolution of the drum, said device (12) being designed on the drum and having localised contact with the reel once during each revolution of the drum and causing said reel to be repositioned.

According to a second aspect, the machine is characterised in that the device comprises, on one of the lateral end shields (3*d*) at the end of the drum, a protruding finger-shaped thick area (12), said drum being designed opposite said finger with a smooth area (3*g*) which forms a break in the non-slip area (3*a*), the width of said smooth area between the non-slip parts being such that there is only contact with the reel.

BRIEF DESCRIPTION OF THE SEVERAL VIEWS OF THE DRAWINGS

These aspects and others will become apparent from the following description.

The object of the present invention is described, merely by way of example, in the accompanying drawings in which.

DETAILED DESCRIPTION

Figure 1:
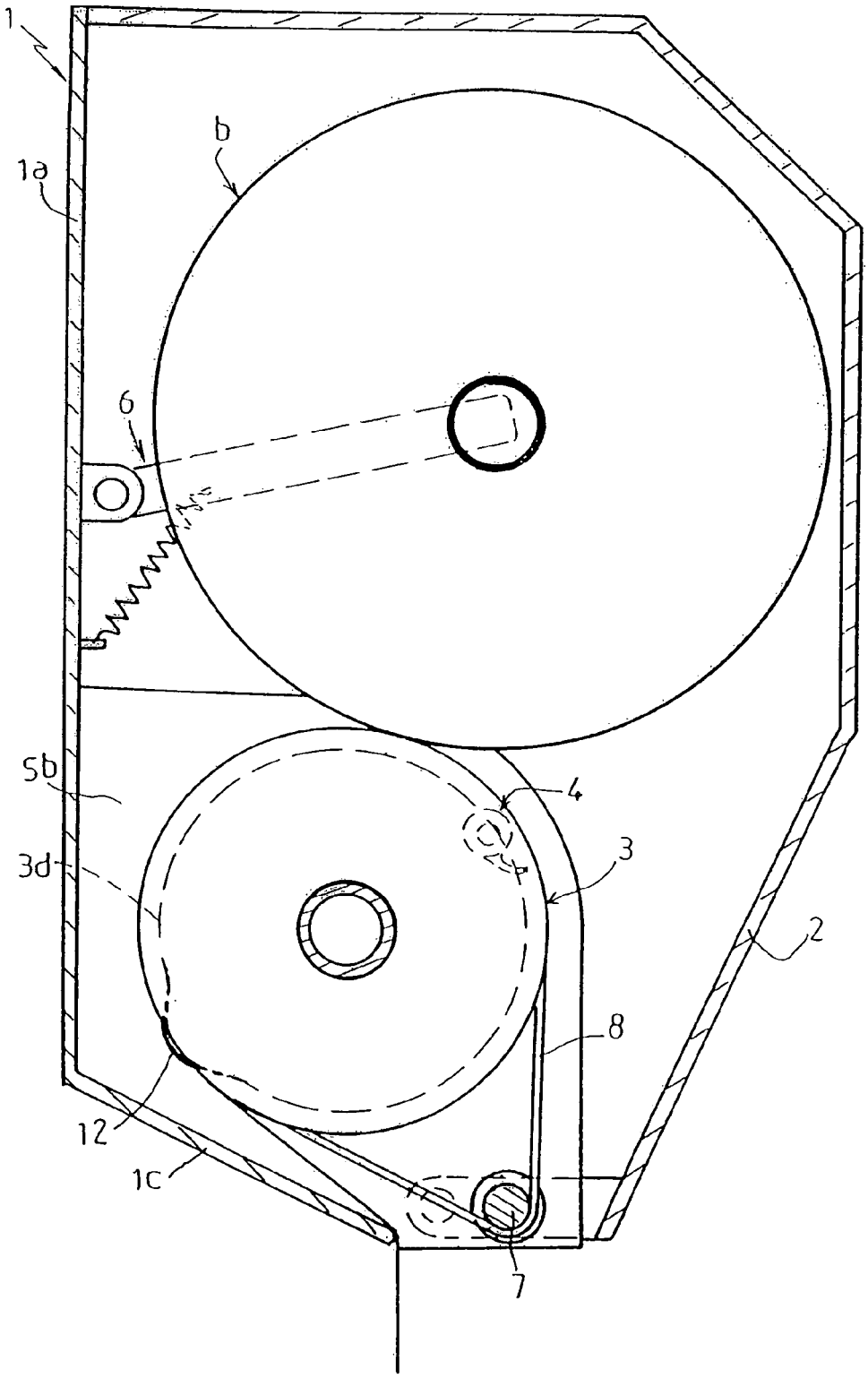
FIG. 1 is a view of the machine according to the invention shown in its idle state. This view is along line A.1 in FIG. 2.
Figure 2:
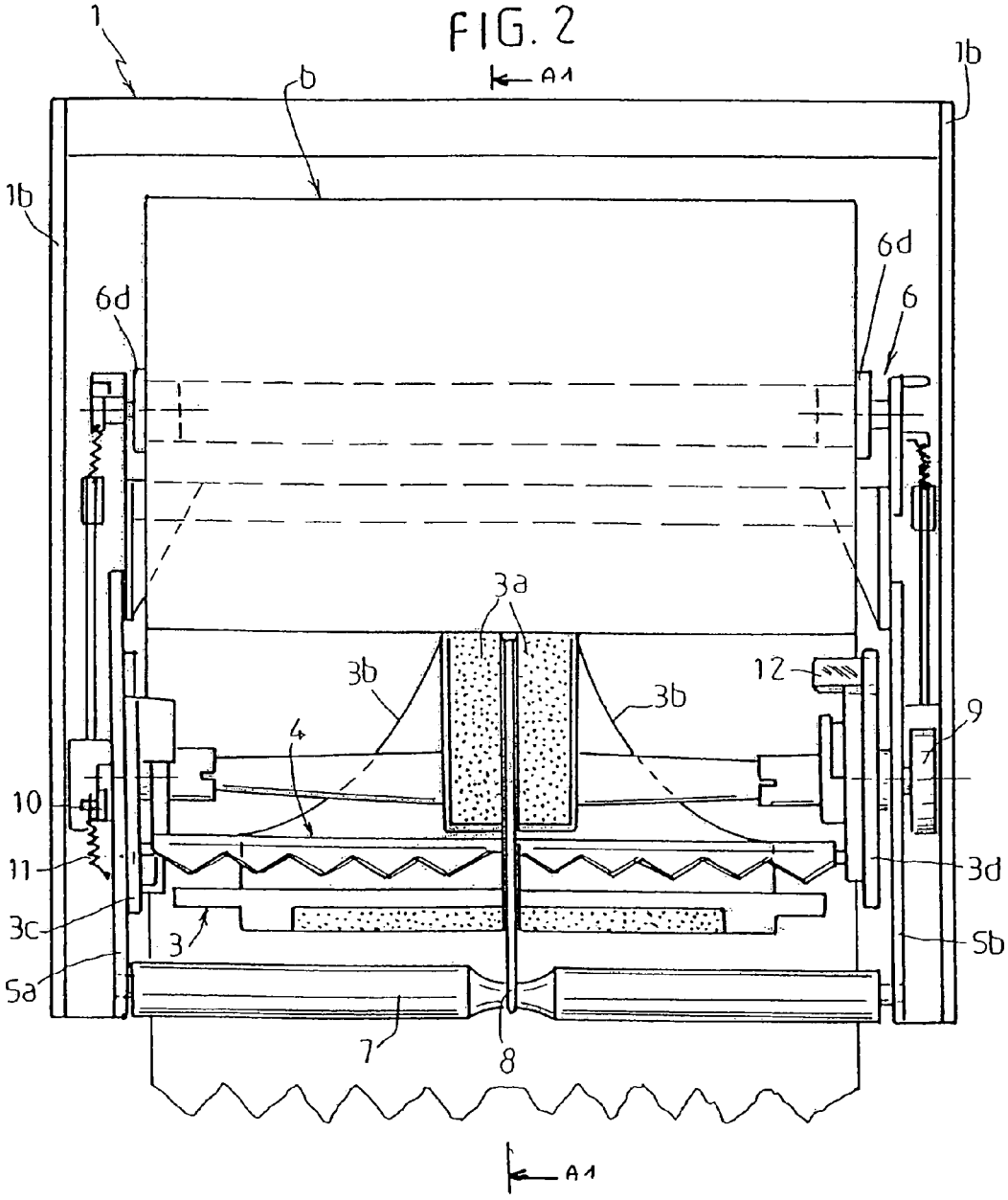
FIG. 2 is a front view, in accordance with the invention, with the cover removed or lowered so as to show the device according to the invention when the machine is in its idle state.
Figure 3:
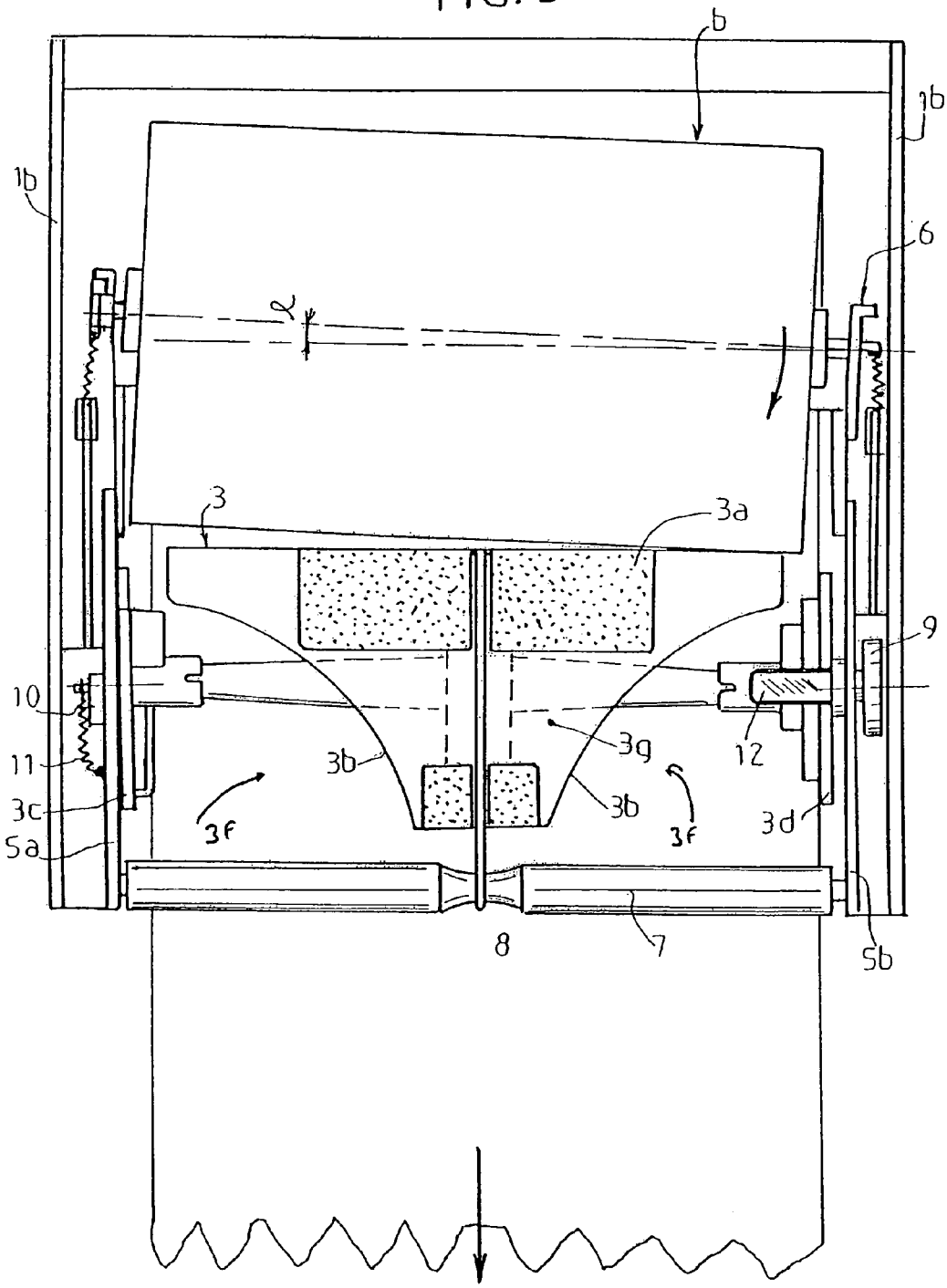
FIG. 3 is a view according to FIG. 2 when the machine is operating and a tensile force is exerted with deflection of the reel of material.
Figure 4:
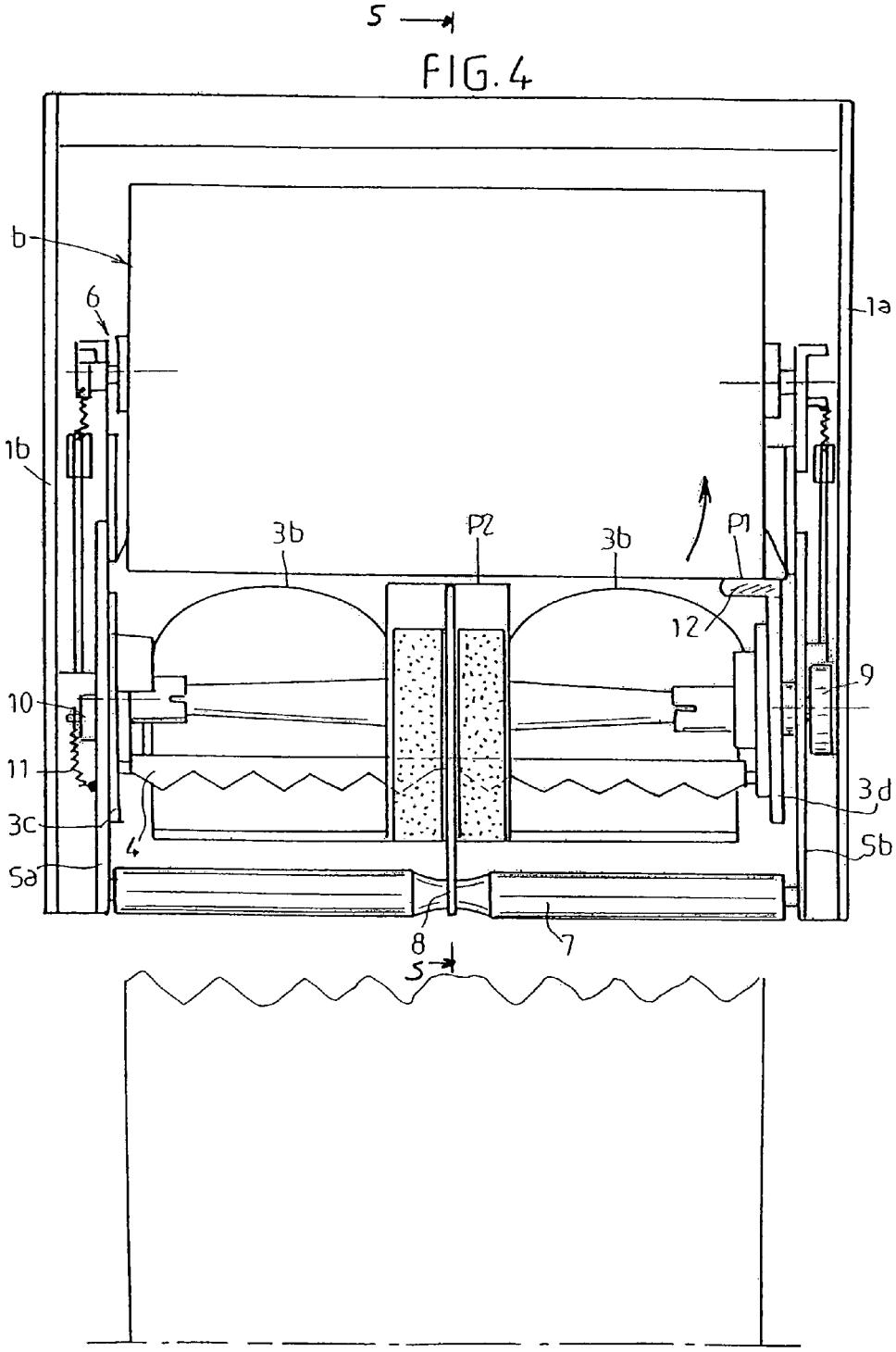
FIG. 4 is an additional view to that in FIG. 3 showing how the device for monitoring and readjusting the position of the reel of material acts.
Figure 5:
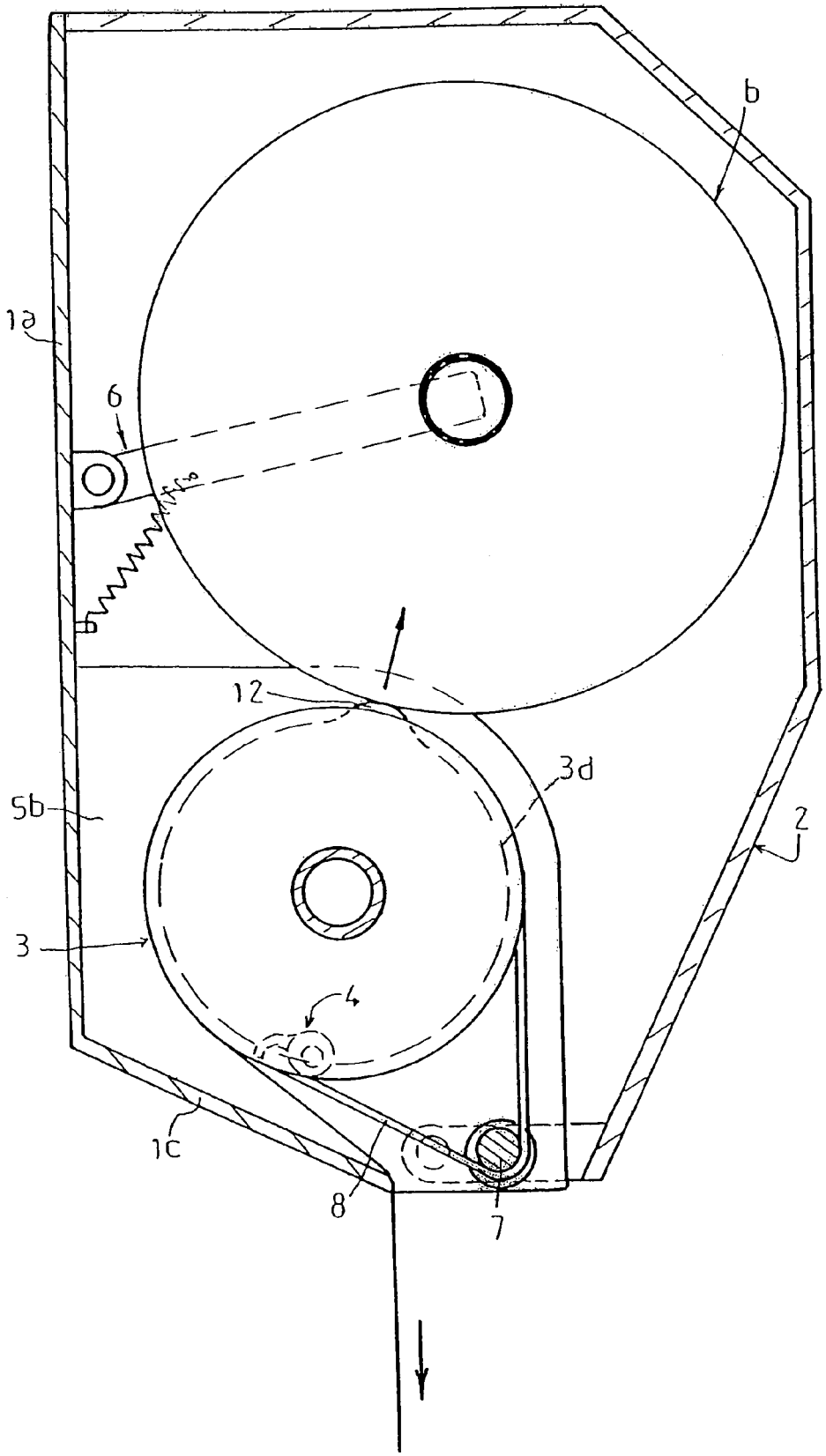
FIG. 5 is a side view along line 5.5 in FIG. 4 with the reel of material being repositioned.

In order that the present invention may more readily be understood, the following description is given, merely by way of example, reference being made to the accompanying drawings.

The machine comprises, in a known manner, an internally hollow rotating drum (3) which accommodates a cutting device (4) with a blade holder. Drum (3) has two disc-shaped lateral end shields (3*c*–3*d*). The drum is rotated relative to the end shields (5*a*–5*b*) of the housing. It comprises a first protruding end (3*c*) associated with end shields (5*a*) with the means described in previous patents using a system with a cam (10) and starting and return spring (11). The other end (3*d*) of the drum extends on the other side of the machine beyond opposite end shield (5*b*) and accommodates the load button (9). The body of the drum may be an internally hollow closed cylinder with a longitudinal slit through which the cutting blade passes and accommodating an external non-slip friction strip (3*a*) with a longitudinal slit through which the cutting device is ejected. It may have, over part of its periphery, weight-reduction areas (3*f*) previously described in Patent No. 2656601 and shown merely by way of example in the drawings. The cutting device may be of the type described in French Patent No. 2787986.

The device for monitoring and repositioning the reel of material in accordance with the invention is designed as follows. One (3*d*) of the lateral discs of the drum, ideally that located on the right-hand side of the machine corresponding to the lower slanting part of the reel of material, has an integrally moulded or separately mounted protruding finger-shaped thick area (12) capable of being in contact with the reel of material (b) once every revolution of the drum. In addition, the drum has, opposite the location of said finger (12), a smooth area (3*g*) which forms a break in the non-slip area (3*a*). Such an arrangement is shown in the drawings. The position of protruding finger (12) is such that it is in a plane (P1) which is above the plane (P2) of the generating line of the non-slip area of the drum so that, when the drum rotates, the reel which is partially in contact with said finger causes the reel of material to be lifted in order to allow its position to be readjusted so that it is not slanting and therefore perfectly parallel to the centre line of the drum. The lifting finger is provided in order to allow occasional lifting of the reel sufficiently to allow it to be repositioned and adjusted. The width of the smooth area (3*g*) between the two non-slip parts (3*a*) of the drum is also such that there is no contact with the reel of material and no retention or braking effect.

Assuming that the surface of the drum is solid, the smooth area is established over the entire length of said drum, its width exceeds the width of the lifting finger. Alternatively, if the drum has openings or cut-outs described in Patent 89/17570, the smooth area is established on the part which corresponds to the surface which is opposite the lifting finger.

It should also be noted that the lifting finger is located in a plane which is substantially opposite the location where the cutting blade is ejected, i.e. after cutting the strip of material. It is therefore apparent that there is automatic readjustment of the position of the reel of material once every revolution which solves the problem in question and avoids having to actuate the load button.

The solution offered by the invention is simple to implement and does not require any additional component.

The invention claimed is:

1. A machine for dispensing a strip of wipe material with automatic cutting, comprising: a housing having a back, two lateral wings, the lower part of each wing extends with a slanting profile and accommodating a cover, said housing accommodating an internally hollow drum with a longitudinal slit which accommodates an articulated cutting device, with an articulated cutting blade, and lateral end shields, said housing accommodating two end shields of articulated design to accommodate a reel holder which supports a reel of wipe material, said drum having, over part of its periphery, a non-slip friction strip, said drum being associated with means of starting, a cam and return spring and a load button, and a device for monitoring and repositioning the reel of wipe material which comes into action once during each revolution of the drum, said device being located on the drum and having localized contact with the reel once during each revolution of the drum and causing said reel to be repositioned, the device comprising, on one of the lateral end shields at an end of the drum, a protruding finger-shaped thick area, said drum being provided opposite said finger with a smooth area which forms a break in and divides the non-slip strip into non-slip parts, a width of said smooth area between the non-slip parts being such that there is no contact of the non-slip parts with the reel when said thick area comes in contact with said reel of wipe material.

2. A machine as claimed in claim 1, wherein protruding parts of the finger-shaped thick area are in a plane which is above a plane of the smooth area of the drum.

3. A machine as claimed in claim 1 wherein the drum is an internally hollow closed cylinder with a longitudinal slit through which the cutting blade passes.

4. A machine as claimed in claim 1 wherein the drum has, over part of its periphery, weight-reduction areas.

* * * * *